US006582186B2

(12) United States Patent
Manzoori et al.

(10) Patent No.: US 6,582,186 B2
(45) Date of Patent: Jun. 24, 2003

(54) VANE ASSEMBLY

(75) Inventors: Rez Manzoori, Derby (GB); Michael J L Percival, Derby (GB); Graham M Upton, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/925,502

(22) Filed: Aug. 10, 2001

(65) Prior Publication Data

US 2002/0028133 A1 Mar. 7, 2002

(30) Foreign Application Priority Data

Aug. 18, 2000 (GB) ..... 0020295

(51) Int. Cl.[7] ..... F01D 9/06
(52) U.S. Cl. ..... 415/96 A; 416/97 R; 415/115
(58) Field of Search ..... 415/115; 416/96 A, 416/97 R, 96

(56) References Cited

U.S. PATENT DOCUMENTS 2,923,525 A * 2/1960 Creek
4,252,501 A * 2/1981 Peill ..... 415/115
4,312,624 A * 1/1982 Steinbauer, Jr. et al. .... 415/115
4,437,810 A * 3/1984 Pearce ..... 415/115
5,511,937 A * 4/1996 Papageorgiou ..... 415/115
6,318,963 B1 * 11/2001 Emery et al. ..... 416/96 A
6,467,167 B2 * 10/2002 Dodd ..... 29/889.72

* cited by examiner

*Primary Examiner*—Edward K. Look
*Assistant Examiner*—James M McAleenan
(74) *Attorney, Agent, or Firm*—W. Warren Taltavull; Manelli, Denison & Selter PLLC

(57) ABSTRACT

A vane assembly 40 for use within a gas turbine engine has a main vane portion 42 with an internal cavity 44. A cavity insert 46 is located within the cavity 44, close to the wall 48 to define transpiration cooling paths. Cooling air leaves the insert 46 through apertures directed at the wall 48, to produce impingement cooling. The transpiration cooling paths are extended back to the trailing edge 66 by means of a fairing 54. The use of a fairing in addition to the insert allows more complicated cavity shapes to be filled.

23 Claims, 3 Drawing Sheets

Prior Art

VANE ASSEMBLY

FIELD OF THE INVENTION

The present invention relates to vane assemblies for gas turbine engines.

BACKGROUND OF THE INVENTION

A conventional multi-shaft gas turbine engine incorporates rotating, load-transmitting shafts which connect fans or compressors toward the upstream end of the engine, with turbines toward the downstream end of the engine. The fans, compressors and turbines are formed by rotating groups of blades through which the engine gases flow. Gas flow paths are conventionally controlled by placing fixed vanes, such as stator vanes and nozzle guide vanes, at various positions along the gas flow path, particularly at positions immediately upstream of compressors and turbines, in order to guide gases moving through the engine toward downstream components along desirable paths.

The vanes require cooling during engine operation and the present invention seeks to address this requirement.

SUMMARY OF THE INVENTION

The invention provides a vane assembly for a gas turbine engine, comprising a vane with an internal cavity, a cavity insert which, in use, is located within the cavity and adjacent the cavity wall to define therewith a path or paths for transpiration cooling across the wall surface, the cavity insert having an internal chamber to which cooling air is introduced, during use, and which has a plurality of exit openings to direct cooling air against the cavity wall for impingement cooling, and into the transpiration path, and the assembly further comprising at least one further cavity insert so shaped and positioned as to define with the cavity wall an extension to the or at least one of the transpiration paths.

The extension and the or a corresponding transpiration path preferably form a substantially continuous path. The extension path preferably extends from the downstream end of the or a transpiration path. The extension path preferably extends to a location at which cooling gas may vent from the vane.

Preferably the cavity insert and the further insert abut ribs formed along the cavity wall, to define at least one substantially wholly enclosed transpiration path and extension. Preferably the ribs extend in a chordal direction.

Preferably a plurality of extension paths are defined, each in communication with a respective transpiration path.

An attachment member, such as a flange, is preferably provided for attachment of the cavity insert to the vane, preferably by brazing, and preferably the flange closes off a transpiration path at an end of the vane to prevent egress of cooling air through the vane end. Preferably the vane is a nozzle guide vane.

In a second aspect, the invention provides a vane assembly comprising a vane with an internal cavity, a cavity insert which, in use, is located adjacent the cavity wall to define therewith a path or paths for transpiration cooling across the wall surface, the assembly further comprising an attachment member which bridges between the cavity wall and the cavity insert at or near one end of the vane to attach the cavity insert to the vane and to close the transpiration path at that end of the vane.

Preferably the attachment member is a flange, preferably carried by the cavity insert and preferably attached by brazing.

Preferably the cavity insert has an internal chamber to which cooling air is introduced, during use, and which has a plurality of exit openings to direct cooling air against the cavity wall for impingement cooling, and into the transpiration path, the assembly further comprising at least one further cavity insert so shaped and positioned as to define with the cavity wall an extension to the or at least one of the transpiration paths.

The extension and the or a corresponding transpiration path preferably form a substantially continuous path. The extension path preferably extends from the downstream end of the or a transpiration path. The extension path extends to a location at which cooling gas may vent from the vane.

Preferably the cavity insert and the further insert abut ribs formed along the cavity wall, to define at least one substantially wholly enclosed transpiration path and extension. Preferably the ribs extend in a chordal direction.

Preferably a plurality of extension paths are defined, each in communication with a respective transpiration path.

Preferably the vane is a nozzle guide vane.

BRIEF DESCRIPTION OF THE DRAWINGS

An embodiment of the present invention will now be described in more detail, by way of example only, and with reference to the accompanying figures, in which.

DETAILED DESCRIPTION OF THE INVENTION

Figure 1:
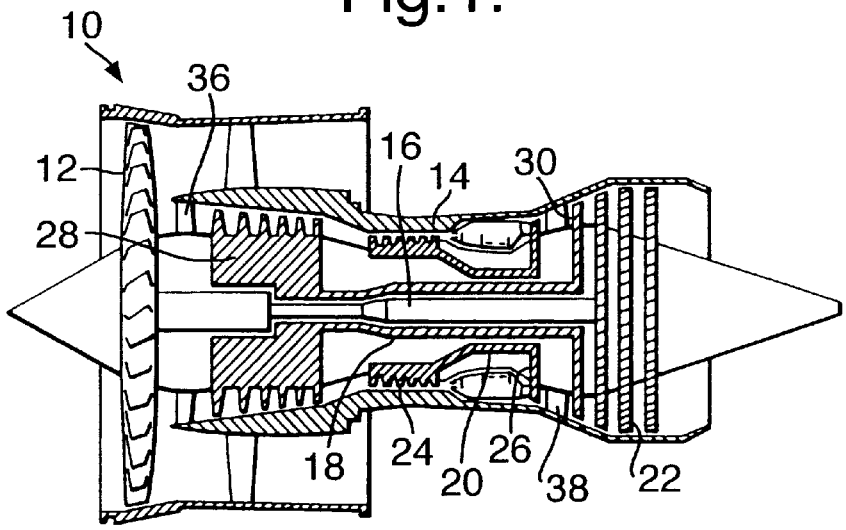
FIG. 1 is a schematic diagram of a conventional gas turbine engine.
Figure 2:
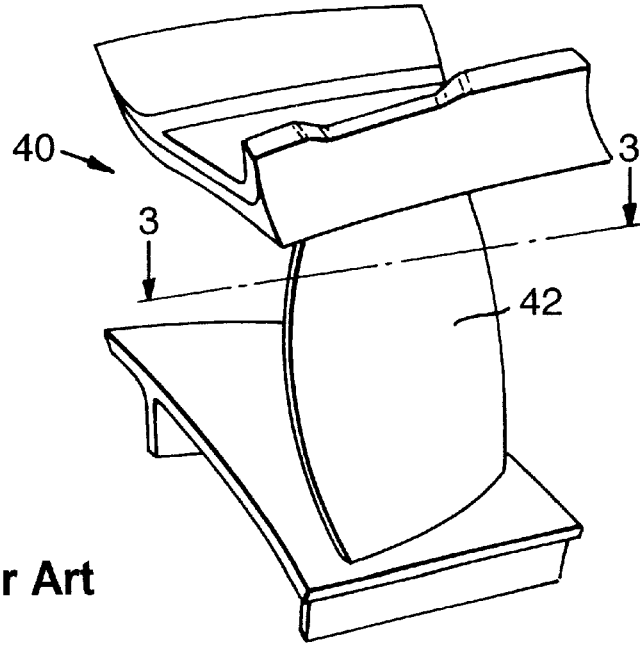
Prior Art Fig.2.
FIG. 2 is a perspective view of a nozzle guide vane from the engine of FIG. 1.

FIG. 1 shows a conventional gas turbine engine 10. The engine 10 comprises a front fan assembly 12 and a core engine 14. The engine is of the ducted fan by-pass type and in this example has three relatively rotatable shafts including a low pressure shaft 16, an intermediate pressure shaft 18 and a high pressure shaft 20. The low pressure shaft 16 is a load transmitting shaft interconnecting the fan 12 and a turbine assembly 22 located at the downstream end of the core engine 14. The intermediate pressure shaft 18 is a hollow load transmitting shaft concentrically disposed around the shaft 16 and interconnecting a multi-stage axial flow compressor 28 and a turbine rotor assembly 30. The high pressure shaft 20 is similarly a hollow load transmitting shaft concentric with the shafts 16 and 18, and interconnecting a multi-stage axial flow compressor 24 and a turbine rotor assembly 26.

Vanes are provided at various locations within the engine 10, to improve gas flow. For example, stator vanes 36 are provided immediately upstream of the IP compressor 28. Nozzle guide vanes 38 are provided immediately upstream of the IP turbine 30. The vanes 36, 38 are shown highly schematically in FIG. 1. Additional vanes, not shown for reasons of clarity, would conventionally be provided at other locations along the gas flow path.

The engine 10 is conventional to the extent so far described in relation to FIG. 1, in the preceding two paragraphs.

The remaining figures relate to a vane assembly 40 for use within the engine 10 in place of conventional vane assemblies. The vane assembly to be described and illustrated is intended for use as an IP nozzle guide vane (i.e. upstream of the IP compressor), but it will be readily apparent to the skilled man that the invention could also be embodied elsewhere within the engine 10.

Figure 3:
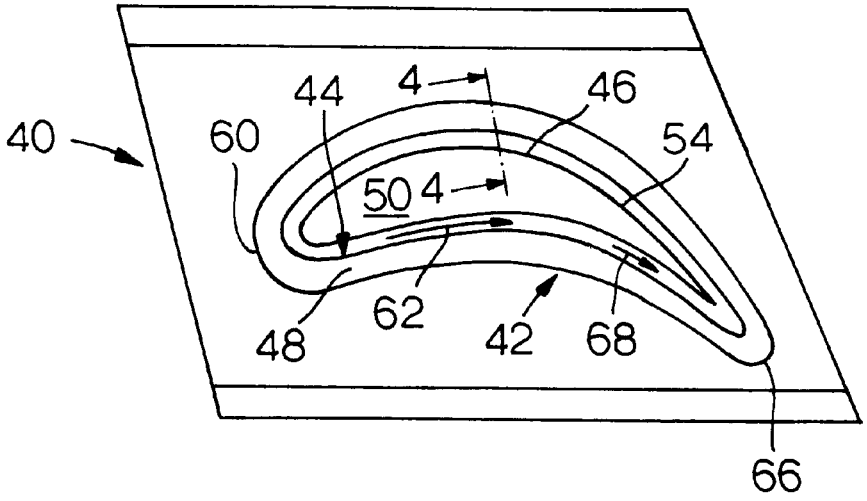
FIG. 3 is a section through the vane of FIG. 2, along the line 3—3 of FIG. 2.
Figure 5:
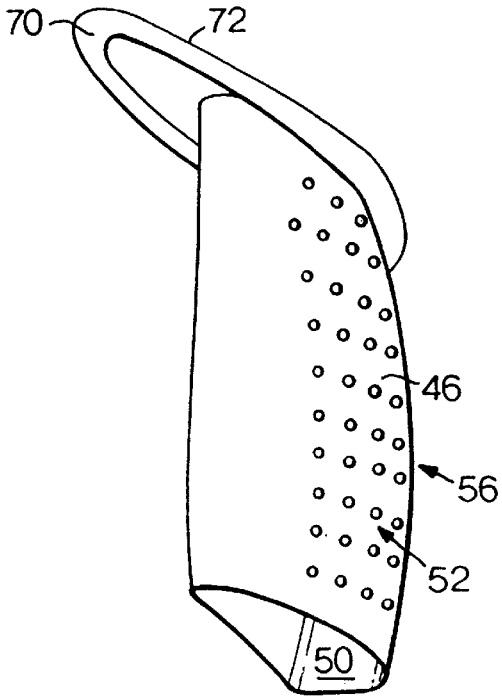
FIG. 5 is a simplified perspective view of a cavity insert for use with the vane of FIGS. 2 and 3.

The vane assembly 40 comprises a main vane portion 42 shaped to create the required flow path by interaction with the gas stream in which the vane assembly 40 is located. The vane has an internal cavity 44 (FIG. 3). A cavity insert 46 is located within the cavity 44 and lies closely adjacent the cavity wall 48 to define therewith a path for transpiration cooling by movement along the face of the wall surface 48, as will be described. The cavity insert 46 itself has an internal chamber to which cooling air is introduced during use. A plurality of exit openings, in the form of fine apertures 52 (FIG. 5) direct cooling air against the cavity wall 48 for impingement cooling, as will be described, and into the transpiration path. The assembly 40 further comprises a further insert in the form of a fairing 54 which is shaped and positioned to define an extension to the transpiration paths, by close spacing from the cavity wall 48.

The cavity insert 46 is formed as a relatively thin-walled tubular body 56 which may, for example, be formed of thin sheet metal shaped so that upon insertion into the cavity 44, the insert 46 closely matches the geometry of the cavity wall 48, leaving a narrow gap 58.

The apertures 52 allow cooling air supplied to the chamber 50 to leave the insert 46 and impinge on the wall 48, for impingement cooling of areas defined by the location of the apertures 52. In this example, the impingement cooling takes place primarily in the vicinity of the leading edge 60 of the vane 42, as can be seen from FIG. 5.

Figure 4:
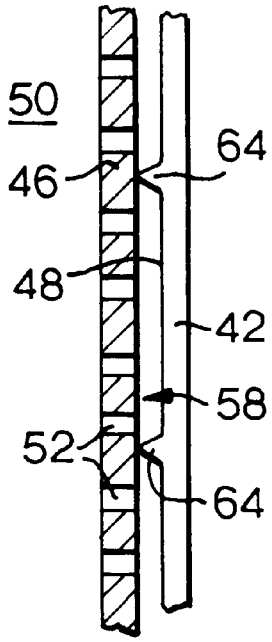
FIG. 4 is a partial section through the vane of FIG. 2, along the line 4—4 of FIG. 3.
Figure 6:
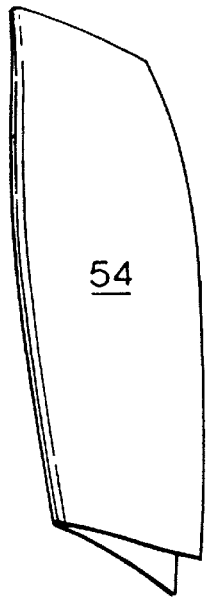
FIG. 6 is a perspective view of a fairing for use with the insert of FIG. 4.
Figure 7:
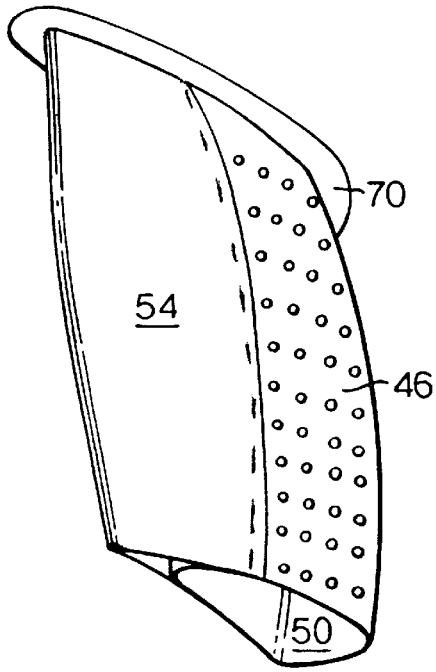
FIG. 7 illustrates the assembled insert and fairing.

After impinging on the wall 48, the cooling air can travel through the gap 58. The insert 46 and wall 48 define between them the path along which the air may flow. As the air flows in this manner, transpiration cooling of the wall 48 is achieved by the flow of cooling air across the wall surface. The direction of flow along the transpiration path is indicated schematically in FIG. 3 by the arrow 62. The transpiration path 62 is further constrained by ribs 64 on the inner face of the wall 48, shown particularly in FIG. 4. The ribs 64 are chordal ribs, extending from the leading edge 60 to the trailing edge 66 of the vane 42. The ribs 64 stand sufficiently proud from the wall 48 that when the insert 46 is within the cavity 44, the outer surface of the insert 46 abuts the peaks of the ribs 64. Consequently, the ribs 64 break up the gap 58 into a series of chordal transpiration paths between adjacent ribs 64 and to which cooling air is supplied through the apertures 52, near the leading edge 60, and then flows along the path, contained by the insert 46, wall 48 and ribs 64, in the direction of the trailing edge 66 in which vent apertures (not shown) are provided to allow cooling air to vent from the vane 42 into the main gas stream through the engine 10. However, as can be seen from FIG. 3, the insert 46 does not itself extend back to the trailing edge 66. Instead, a further insert in the form of the fairing 54 is provided. This is formed of similar material to the insert 46, such as thin metal, folded to provide a tapering fairing (FIG. 6) which can be placed alongside the insert 46, as shown in FIG. 7, to form therewith a smooth surface which closely matches the shape of the wall 48 throughout the whole of the cavity 44.

Thus, after cooling air leaves the transpiration paths 62 defined in part by the insert 46, the air will enter similar extension paths defined between the fairing 54, wall 48 and ribs 64 in generally the same manner as has been described above, and extending from the downstream end of the transpiration path 62, to the trailing edge 66, to allow cooling air to vent from the trailing edge 66, as has been described. Appropriate shaping of the insert 46 and fairing 54 will ensure a smooth transition from the transpiration path 62 to the extension path illustrated by the arrow 68 (FIG. 3).

It can thus be understood from the previous description, that whereas the insert 46 performs the two functions of supplying cooling air for impingement cooling of the wall 48 and for guiding air along the transpiration paths, the fairing 54 performs only the second of these functions, along the extension paths 68, and is not supplied internally with cooling air.

It is envisaged that by careful selection of the division of the overall construction into the main insert 46 and the fairing 54, and by the use of additional fairings, if appropriate, a structure can be formed which closely matches the cavity wall geometry even when that is complicated, as is becoming common with nozzle guide vanes of shorter chordal length and substantial tangential lean and curvature.

The insert 46 and fairing 54 are installed within the vane 42 by means of a flange 70 attached to the insert 46 at the radially outer end of the vane 42. The flange 70 has an outer edge 72 which is complementary with the shape of the wall 48 at the position of attachment, to allow attachment and thereby to seal the transpiration paths 62 at the end of the vane 42. Attachment between the flange 70 and the vane 42 is preferably by means of brazing, which is particularly desirable in the event that the vane 42 is formed as a single crystal of alloy, to provide an air seal without re-crystallisation and mechanical problems associated with welding.

The fairing 54 can also be attached to the flange 70, either before or after the insert 46 is inserted in the cavity 44, and preferably also by brazing. Leakage of cooling air from the vane 42 through the fairing 54 can be prevented by providing a cap (not shown) across the end of the fairing 54 remote from the flange 70. The cap may be sealed to the insert by welding.

It will be apparent that many variations and modifications can be made from the apparatus described above, without departing from the scope of the invention. In particular, many variations in the geometry and materials can be chosen.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A vane assembly for a gas turbine engine, comprising a vane with an internal cavity having a wall surface, a cavity insert which, in use, is located within the cavity and adjacent the cavity wall surface to define therewith a transpiration path for transpiration cooling across the wall surface, the cavity insert having an internal chamber to which cooling air is introduced, during use, and which has a plurality of exit openings to direct cooling air against the cavity wall surface for impingement cooling, and into the transpiration path, and the assembly further comprising at least one further cavity insert so shaped and positioned as to define with the cavity wall surface an extension to the transpiration path, said extension including a smooth transition between said cavity insert and said further cavity insert to provide a smooth transpiration flow path throughout said internal cavity.

2. An assembly according to claim 1, wherein the extension and the corresponding transpiration flow path define a substantially continuous path.

3. An assembly according to claim 1, wherein said transpiration path includes a downstream end and the extension extends from the downstream end of the transpiration path.

4. An assembly according to claim 1, wherein the extension extends to a location at which cooling gas may vent from the vane.

5. An assembly according to claim 1, wherein the cavity wall includes ribs and the cavity insert and the further insert abut said ribs formed along the cavity wall to define at least one substantially wholly enclosed transpiration path and extension.

6. An assembly according to claim 5, wherein the ribs extend in a chordal direction.

7. An assembly according to claim 1, wherein an attachment member is provided for attachment of the cavity insert to the vane.

8. An assembly according to claim 7, wherein the attachment member is a flange.

9. An assembly according to claim 8, wherein the flange is attached by brazing.

10. An assembly according to claim 8, wherein the vane has an inner and outer end and the flange closes said outer end of the vane to prevent egress of cooling air through the vane outer end.

11. An assembly according to claim 1, wherein the vane is a nozzle guide vane.

12. A vane assembly comprising a vane with an internal cavity having an internal wall surface, a cavity insert which, in use, is located adjacent the cavity internal wall surface to define therewith a path for transpiration cooling across the wall surface, the assembly further comprising an attachment member which bridges between the cavity wall surface and the cavity insert at or near one end of the vane to attach the cavity insert to the vane and to close the transpiration path at that end of the vane, said attachment member including a smooth transition between said cavity insert and said attachment member to provide a smooth transpiration flowpath throughout said internal cavity.

13. An assembly according to claim 12, wherein the attachment member is a flange.

14. An assembly according to claim 13, wherein the flange is carried by the cavity insert.

15. An assembly according to claim 12, wherein the flange is attached by brazing.

16. An assembly according to any of claim 12, wherein the cavity insert has an internal chamber to which cooling air is introduced, during use, and which has a plurality of exit openings to direct cooling air against the cavity wall surface for impingement cooling, and into the transpiration path, and the assembly further comprising at least one further cavity insert so shaped and positioned as to define with the cavity wall surface an extension to the transpiration path.

17. An assembly according to claim 16, wherein the extension path and the transpiration path define a substantially continuous path.

18. An assembly according to claim 16, wherein the transpiration path has a downstream end and the extension path extends from said downstream end of the transpiration path.

19. An assembly according to claim 16, wherein the extension path extends to a location at which air may vent from the vane.

20. An assembly according to claim 16, wherein said cavity internal wall surface has ribs protruding therefrom and the cavity insert and the further insert abut said ribs to define at least one substantially wholly enclose transpiration path and extension.

21. An assembly according to claim 20, wherein the ribs extend in a chordal direction.

22. An assembly according to claim 16, comprising a plurality of extension paths each in communication with a respective transpiration path.

23. An assembly according to claim 12, wherein the vane is a nozzle guide vane.

* * * * *